US005169750A

United States Patent [19]

Vacca

[11] Patent Number: 5,169,750

[45] Date of Patent: Dec. 8, 1992

[54] PROCESS FOR THE PRODUCTION OF PHOTOSENSITIVE SILVER HALIDE EMULSIONS

[75] Inventor: Alberto Vacca, Carcare, Italy

[73] Assignee: Minnesota Mining and Manufacturing Company, St. Paul, Minn.

[21] Appl. No.: 595,032

[22] Filed: Oct. 10, 1990

[30] Foreign Application Priority Data

Oct. 16, 1989 [IT] Italy ..... 22029 A/89

[51] Int. Cl.[5] ..... G03C 1/005

[52] U.S. Cl. ..... 430/569; 430/567

[58] Field of Search ..... 430/569, 567

[56] References Cited

U.S. PATENT DOCUMENTS

| | | | |
|---|---|---|---|
| 4,334,012 | 6/1982 | Mignot | 430/567 |
| 4,336,328 | 6/1982 | Brown et al. | 430/569 |
| 4,539,290 | 9/1985 | Mumaw | 430/569 |
| 4,758,505 | 7/1988 | Hoffman | 430/569 |

FOREIGN PATENT DOCUMENTS

| | | |
|---|---|---|
| 818237 | 1/1975 | Belgium . |
| 1515139 | 12/1975 | United Kingdom . |

OTHER PUBLICATIONS

Research Disclosure Mar. 1975, 13122.
Research Disclosure 10208—Oct. 1972.
Research Disclosure 13577—Jul. 1975.
Research Disclosure 16351—Nov. 1977.

*Primary Examiner*—Charles L. Bowers, Jr.
*Assistant Examiner*—Mark F. Huff
*Attorney, Agent, or Firm*—Gary L. Griswold; Walter N. Kirn; Mark A. Litman

[57] ABSTRACT

An improved process for preparing silver halide emulsions by precipitation of silver halide grains in a single reaction vessel comprising a dispersing medium is disclosed. The process comprises forming a silver halide emulsion by adding silver salt and halide salt solutions in a dispersing medium contained in a reaction vessel to form silver halide nuclei and allowing said silver halide nuclei to grow in said reaction vessel. The improvement comprises, during a pause of addition of silver salt and halide salt solutions, reducing the volume of silver halide emulsion by continuously delivering the silver halide emulsion to a cleaning stage for the partial removal of dispersing medium and any salt soluble therein and returning the silver halide emulsion to the reaction vessel.

6 Claims, 1 Drawing Sheet

PROCESS FOR THE PRODUCTION OF PHOTOSENSITIVE SILVER HALIDE EMULSIONS

FIELD OF THE INVENTION

The present invention relates to a process for the production of photosensitive silver halide emulsions.

BACKGROUND OF THE ART

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. One common technique is a batch process commonly referred to as the double-jet precipitation process by which a silver salt solution in water and a halide salt solution in water are concurrently added into a reaction vessel containing the dispersing medium. Double-jet precipitation processes are described, for example, in GB 1,027,146, GB 1,302,405, U.S. Pat. Nos. 3,801,326, 4,046,376, 3,790,386, 3,897,935, 4,147,551, and 4,171,224. Precipitation of silver halide grains usually occurs in two distinct stages. In a first stage, the nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

The so-called ultrafiltration process is generally used for this purpose. The use of ultrafiltration for removing soluble salts and optimally concentrating silver halide emulsions is illustrated in Research Disclosures 10208 (1972), 13122 (1975), 13577 (1975) and 16351 (1977) and BE 818,237, and makes use of ultrafiltration membranes which can readily separate silver halide grains from the soluble salts and the liquid dispersing medium.

It is already known from U.S. Pat. Nos. 4,334,012 and 4,336,328 that ultrafiltration can be used during silver halide nuclei formation and silver halide grain growth of a silver halide emulsion with reduced variation in or, most preferably, constant volumes of the materials in the reaction vessel.

However, the last-mentioned process has the disadvantage that ultrafiltration during silver halide nuclei formation and grain growth may cause variability in the morphological and photographic characteristics of the silver halide emulsions. Therefore this process finds limitations as a general process for the preparation of silver halide emulsions.

DE 2,555,364 and U.S. Pat. No. 4,758,505 describe processes for silver halide emulsion preparation wherein the different stages of silver halide precipitation occur in different vessels.

SUMMARY OF THE INVENTION

An improved process for preparing silver halide emulsions by precipitation of silver halide grains in a single reaction vessel comprising a dispersing medium is disclosed. The process comprises forming a silver halide emulsion by adding silver salt and halide salt solutions in a dispersing medium contained in a reaction vessel to form silver halide nuclei and allowing said silver halide nuclei to grow in said reaction vessel. The improvement comprises, during a pause of addition of silver salt and halide salt solutions, reducing the volume of silver halide emulsion by continuously delivering the silver halide emulsion to a cleaning stage for the partial removal of dispersing medium and any salt soluble therein and returning that cleaned portion of the silver halide emulsion to the reaction vessel.

The invention provides a process for the preparation of silver halide emulsions wherein the productivity is improved (increasing the amount of silver halide emulsion up to eight times the amount produced in the same vessel with a conventional procedure), less variation in the volume of contents in the reaction vessel occurs, and purification and concentration of the silver halide emulsion is accomplished without interfering with nucleation and growth stages of the silver halide grain precipitation.

BRIEF DESCRIPTION OF THE DRAWINGS

FIG. I illustrates a schematic diagram of a precipitation apparatus according to this invention.

DETAILED DESCRIPTION OF THE INVENTION

Figure 1:
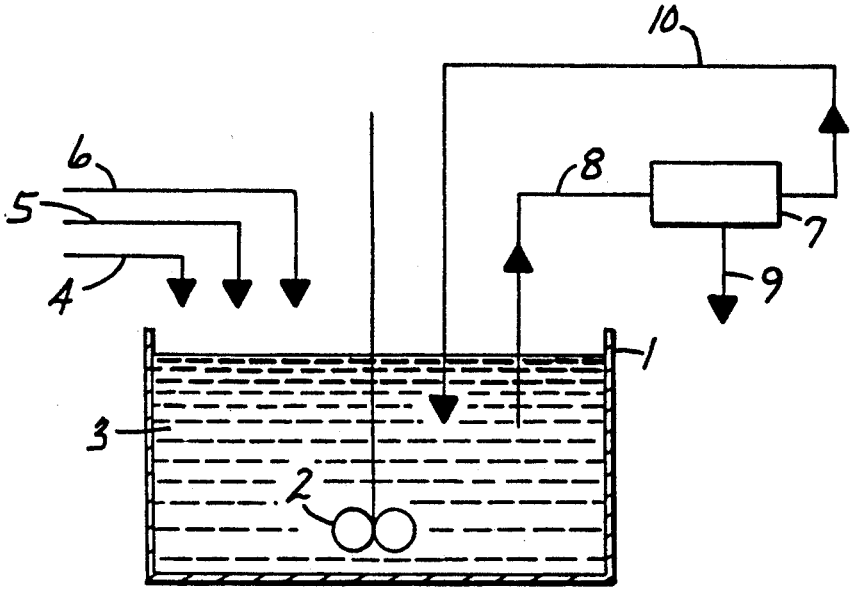

The present invention relates to an improved process for the production of photosensitive silver halide emulsions by reacting at least one silver salt solution with at least one halide salt solution within a dispersing medium contained in a single reaction vessel to achieve silver halide grain nucleation followed by silver halide grain growth, wherein during silver halide nucleation and grain growth the silver salt and halide salt solutions are concurrently added into the reaction vessel containing the dispersing medium, the improvement consisting in that there is at least one pause in the process where there is no addition of silver salt and halide salt solutions and, during at least one pause of addition of silver salt and halide salt solutions, the volume of the silver halide dispersion is reduced by continuously delivering a portion of the silver halide dispersion to a cleaning stage, cleaning said portion of said silver halide dispersion and returning the mass flow of cleaned silver halide dispersion from the cleaning stage to the reaction vessel.

The improved precipitation process of the present invention can be illustrated by reference to the apparatus of FIG. I, wherein the reaction vessel 1 initially contains a dispersing medium 3. The usual dispersing media may be used, the particularly preferred dispersing medium being water or a solution consisting essentially of water. The apparatus comprises an inlet 4 for the introduction of at least one water soluble silver salt, particularly silver nitrate, in aqueous solution and an inlet 5 for the introduction of at least one water soluble halide salt, particularly alkaline metal or ammonium salts of chloride, bromide and iodide and mixture thereof, in aqueous solution into the reaction vessel 1. With a mechanism 2 for stirring the dispersing medium (which mechanism can be of any conventional form) in operation, the silver salt solution is added into the reaction vessel through the inlet 4, and the halide salt solution is concurrently added into the reaction vessel through the inlet 5.

The stirring causes the silver and halide salt solutions to be mixed with the dispersing medium and enables the soluble halide salts to react with the soluble silver salts to form silver halides. During the first stage of silver halide precipitation, the "nucleation stage", a substantially uniform dispersion of silver halide grains, the "nuclei", is formed. Continuing the addition of the silver and halide salt solution, there is a transition to a second stage of the silver halide precipitation, the "growth stage", during which additional silver halide formed as a reaction product precipitates onto the initially formed silver halide grains, causing these grains to increase in size.

According to this invention, there is at least one pause in the addition of silver salt solutions and halide solutions to the reaction vessel, and, during that at least one pause of the silver salt and halide salt addition, a portion of or all of the silver halide content of the reaction vessel is transferred to a cleaning stage wherein the volume is reduced (cleaned) and soluble salts are removed.

Suitable cleaning arrangements are those wherein the dispersing medium and soluble salts dissolved therein can be removed from the silver halide emulsion on a continuous basis, such as, for example, a combination of dialysis or electrodialysis for the removal of soluble salts or a combination of osmosis or reverse osmosis for the removal of the dispersing medium.

In a particularly preferred embodiment, among the known techniques for removing the dispersing medium and soluble salts while retaining silver halide grains in the remaining dispersion, ultrafiltration is a particularly advantageous cleaning arrangement for the practice of this process. Typically, an ultrafiltration unit comprising membranes of inert, non-ionic polymers is used as a cleaning arrangement. Since silver halide grains are large in comparison with the dispersing medium and the soluble salts or ions, silver halide grains are retained by said membranes while the dispersing medium and the soluble salts dissolved therein are removed.

The action mechanism of preferred membranes is described in GB 1,307,331. The membranes used in the ultrafiltration comprise a very thin layer of extremely fine pore texture supported upon a thicker porous structure. Suitable membranes consist of polymers such as polyvinylacetate, polyvinylalcohol, polyvinylformate, polyvinylethers, polyamides, polyimides, polyvinyl and polyvinylidene chloride, aromatic polymers, such as aromatic polyesters, polytetrafluoroethylene, regenerated cellulose, cellulose esters, such as cellulose acetate, or mixed cellulose esters. The membranes in question have anisotropic, semipermeable properties, show considerable mechanical, thermal and chemical stability and are photographically inert. The membranes are preferably permeable to molecules having molecular weights of up to about 300,000 and, more especially, of up to about 50,000.

The silver halide emulsions for use in the process of this invention may vary considerably in their concentration of silver halide and their soluble salts content, depending upon the pause in the silver halide precipitation wherein the emulsion is delivered to the cleaning stage. In general, the silver halide content may be from 0.1 to 3 moles per liter of the emulsion, and preferably from 0.1 to 1 mole per liter of the emulsion and the soluble salt content is from 0.1 to 3 moles per liter.

With reference to the apparatus of FIG. I, the content of the reaction vessel is continuously delivered, during a pause of the addition of silver salts and halide salts, as indicated schematically by flow path 8 to the ultrafiltration unit 7. The ultrafiltration unit reduces the volume of the silver halide emulsion received by separating a portion of the dispersing medium, as indicated schematically by the flow path 9, while retaining the silver halide grains within the remaining silver halide emulsion. The silver halide emulsion thus reduced in volume, referred to as the "retentate", is returned to the reaction vessel, as indicated by the flow path 10. The pressure of the emulsion contacting the ultrafiltration membrane can vary over a wide range. Typically, the pressure within the reaction vessel contacting the ultrafiltration membrane is about 700 kPa, while the outlet pressure of the retentate is up about 70 kPa. The pressure difference across the membrane is typically in the range of from about 280 to 420 kPa. It is however, within the ability of those ordinarily skilled in the art to operate at pressures outside of these ranges, depending upon the construction of the reaction vessel and the ultrafiltration unit, the viscosity of the emulsion, the concentration of the retentate, and the purity of the retentate desired.

Although the process has been described by reference to a single ultrafiltration unit, it is contemplated that two or more ultrafiltration units can be used in series comprising membranes having the same or different penetration to the chemical compounds. Although the invention has been described in terms of an external ultrafiltration unit, so that the emulsion is withdrawn from the reaction vessel, reduced in volume, and returned to the reaction vessel, it is contemplated that ultrafiltration can occur internally of the reaction vessel, for example immersing the ultrafiltration unit in the emulsion within the reaction vessel with the removed soluble salts and dispersing medium conducted out of the reaction vessel through a suitable conduit or using a portion of the wall of the reaction vessel to form the ultrafiltration unit as described in U.S. Pat. No. 4,336,328.

In one preferred embodiment, the precipitation of silver halide grains is carried out in the presence of a hydrophilic colloid as a peptizer. The peptizer may be in the dispersing medium within the reaction vessel prior to the addition of the silver salt and halide salt addition. Alternatively, the peptizer can be added through the inlet 6 or through one of the inlets 4 and 5 above together with the respective silver salt and halide salt solutions, or the peptizer can be introduced into the reaction vessel using any of the above combinations. Suitable hydrophilic colloids are the conventional types, for example proteins, particularly gelatin, alginic acid and derivatives thereof, such esters, amides or salts, cellulose derivatives, such as carboxymethyl cellulose or cellulose sulfates, starch or derivatives thereof or hydrophilic synthetic binders, such as polyvinylalcohol, partially hydrolized polyvinylacetate and polyvinylpyrrolidone. The peptizers may contain in admixture with the hydrophilic colloids other synthetic binders in dissolved or dispersed form, such as homopolymers or copolymers of acrylic or methacrylic acid or derivatives thereof, such as esters, amides or nitriles, also vinyl polymers, such as vinylesters or vinylethers. In this connection, reference is made for example to Research Disclosure 22534, 1983, p.23. However, the silver halide emulsions may also be precipitated in the absence of a peptizer. Where precipitation is carried out in the presence of gelatin, a gelatin to silver weight ratio of from 0.01 to 1 is preferably maintained at the end of the precipitation. The concentration of the gelatin of the silver halide emulsion may vary considerably, depending upon the pause in the silver halide precipitation wherein the emulsion is delivered to the cleaning stage. In general, the gelatin concentration may be from 0.01% to 12% by weight and preferably 1% to 4% of the total weight of the solids in the emulsion. Advantageously, ultrafiltration does not remove any substantial proportion of the peptizer, but selectively removes the dispersing medium and the alkali or ammonium nitrate dissolved in the dispersing medium.

According to the process of this invention, it is possible to separate dispersing media and/or soluble salts from the silver halide emulsions by using the cleaning stage during a pause in the silver halide grain precipitation. That means that the addition of silver salt and halide salt solutions is stopped during the time in which the silver halide emulsion is delivered to the cleaning unit and returned to the reaction vessel. The cleaning stage can be conducted during said pause at any stage of the silver halide grains precipitation. The cleaning stage is preferably conducted in a pause after the nucleation of silver halide grain formation and is most preferably conducted in at least one pause during the growth stage. Advantageously, the cleaning stage is conducted in a pause after the nucleation and in more than one pause during the growth stage. A cleaning stage is typically conducted also at the end of silver halide precipitation to separate dispersing media and/or soluble salts added after the last pause in the growth stage. As said before, ultrafiltration is the preferred cleaning technique to separate dispersing media and/or soluble salts according to the process of this invention and offers a number of advantages versus other cleaning techniques. One of the advantages of the ultrafiltration is that the time required for separating dispersing media and/or soluble salts is very short, so that the total time of silver halide precipitation is substantially not increased by the pauses during which the ultrafiltration is conducted.

According to the process of this invention, the volume of the silver halide emulsion within the reaction vessel can be adjusted to any desired level by controlling the proportion of the dispersing medium removed by the ultrafiltration; this is made by adjusting the flow rate of the contents in the reaction vessel to and from the ultrafiltration unit and the pressure difference across the membranes. It is specifically contemplated to remove the dispersing medium in a proportion of 10 to 90 percent of the total volume introduced through the silver and halide salt inlets and the additional inlet. It is generally preferred that the proportion of the dispersing medium removed be at least 50 percent of the total materials introduced. In a more preferred form of the process of this invention, the silver halide emulsion preparation occurs with reduced variation in or, most preferably, constant volume of the content in the reaction vessel by removing, during the pause of addition of silver and halide salt solutions, a proportion of dispersing medium substantially equivalent to the volume of the dispersing medium added during the subsequent addition of silver salt and halide salts solutions.

Silver chloride, bromide and iodide or mixtures thereof may be prepared, according to the process of this invention, as photosensitive silver halide emulsions.

The silver halide grains produced according to this process can include coarse, medium or fine silver halide grains bounded by 100, 111 or 110 crystal planes as known in the photographic art. Said grains may have one of the known form, such as cubic, octahedral, mixed tetra-decahedral or tabular form.

The silver halide emulsions produced according to this invention may exhibit a broad (polydispersed) or a narrow (momodispersed) size-frequency distribution of the grains. Polydispersed emulsions, that is those having at least 10% and preferably at least 20%, in number or weight, of the grains with a diameter differing by at least 40% from the mean grain diameter, can be produced by additional nucleation occurring during the growth stage or by variation in growth rates from grain to grain, as can result form crystal irregularities in the individual grains. Monodispersed emulsions are those having at least 95%, by number or weight, of the silver halide grains with a diameter differing by less than 40% from the mean grain diameter.

The silver halide emulsions may be chemically sensitized using the usual sensitizing agents. Sulfur containing compounds, gold and noble metal compounds, polyoxylakylene compounds are particularly suitable. Methods for chemically sensitizing silver halide emulsions are described, for example, in Research Disclosure 17643, Section III, 1978.

The silver halide emulsions may be optically sensitized in known manner, as described for example in Research Disclosure 17643, Section IV, 1978, using the usual polymethine dyes, such as cyanines, carbocyanines, rhodacyanines, hemicyanines, styryl dyes, oxonols and the like.

The usual antifoggants and stabilizers may be used as described in Research Disclosure 17643, Section VI, 1978, such as azaindenes.

Other suitable addenda, such as hardeners, coating aids, plasticizers, matting agents, developing agents, color couplers, absorbing and scattering materials, which may be added to the silver halide emulsions are described in Research Disclosure 17643, 1978.

The silver halide emulsions prepared according to the process of this invention may be used as photosensitive emulsions for various photographic materials, such as high surface sensitivity or high internal sensitivity negative emulsions, surface-fogged or unfogged direct-positive emulsions, print-out emulsions, reversal emulsions, emulsions for black-and-white materials, for color materials, radiographic materials, transfer color materials, and the like.

The photographic materials, including a silver halide emulsion prepared according to this invention, may be processed to form a visible image upon association of the silver halides with an alkaline aqueous medium in the presence of a developing agent contained in the medium or in the material, as known in the art. In the case of color photographic materials, the processing comprises at least a color developing bath and, optionally, a prehardening bath, a neutralizing bath, a first (black and white) developing bath, etc. These and other baths which complete the photographic processing (e.g., bleaching, fixing, bleach-fixing, intensifying, stabilizing and washing baths) are well known in the art and are described for instance in Research Disclosure 17643, 1978.

The present invention is now illustrated by reference to the following examples.

EXAMPLE 1

A cubic monodispersed 0.15 micrometers seven mole silver chlorobromide (40 mole percent bromide) emulsion (Comparison Emulsion) was prepared as follows using the apparatus shown in FIG. 1.

A solution (A) consisting of 1750 ml water, 0.3 g adenine and 70 g gelatin was initially introduced into a 7 liter reaction vessel 1. The components used for the precipitation and growth of silver chlorobromide grains were a solution (B) of 1190 g silver nitrate and 2100 ml water and a solution (C) of 332 g KBr, 313 g KCl and 2100 water.

Solutions (B) and (C) were introduced into the reaction vessel 1 through inlets 4 and 5 simultaneously with a vigorous stirrer 2 for a period of 30 minutes at 52° C. with a flow rate of 10.1 ml/min per mole of silver while maintaining the pAg of the content in the reaction vessel at 8.0.

After solutions (B) and (C) have been completely added, the content of the reaction vessel was fed to an ultrafiltration unit 7 fitted with four polysulfone semipermeable membranes having a total working surface of 1.84 $m^2$ and a NMWL (Nominal Molecular Weight Limit) of 100,000 and washed at constant volume by diafiltration while continously adding makeup water (3 l per mole of silver) to the emulsion.

A second cubic monodispersed 0.15 micrometers seventeen mole silver chlorobromide (40 mole percent bromide) emulsion (Emulsion of the invention) was prepared as follows using the apparatus shown in FIG. I.

A solution ($A_1$) consisting of 4250 ml water, 0.73 g adenine and 170 g gelatin was initially introduced into the 7 liter reaction vessel 1. The components used for the precipitation and growth of the silver chlorobromide grains were a solution ($B_1$) of 2890 g silver nitrate and 5100 ml water and a solution ($C_1$) of 809 g KBr, 760 g KCl and 5100 ml water.

Step 1—Nucleation

Solutions ($B_1$) and ($C_1$) were introduced into the reaction vessel containing solution ($A_1$) at 52° C. through inlets 4 and 5 simultaneously for a period of 5 minutes with a flow rate of 10.1 ml/min per mole of silver while the pAg of the content in the reaction vessel was maintained at 8.0 and the volume of the content in the reaction vessel was increased from 4290 to 5627 ml.

Step 2—Washing and Concentration

Five minutes after beginning the precipitation, addition of solutions ($B_1$) and ($C_1$) was stopped and the content of the reaction vessel was cycled for 3 minutes through the ultrafiltration unit of the type described above to reduce the volume of the content in the reaction vessel from 5627 to 4250 ml.

Step 3—Growth

Eight minutes after beginning, additions of solutions ($B_1$) and ($C_1$) started again for a period of 5 minutes with a flow rate of 10.1 ml/min at a constant pAg of 8.0 and the volume of the content in the reaction vessel was increased from 4250 to 5627 ml.

Step 4—Washing and Concentration

Step 2 was repeated.

Step 5—Growth

Step 3 was repeated.

Step 6—Washing and Concentration

Step 2 was repeated.

Step 7—Growth

Step 3 was repeated.

Step 8—Washing and Concentration

Step 2 was repeated.

Step 9—Growth

Step 3 was repeated.

Step 10—Washing and Concentration

Step 2 was repeated.

Step 11—Growth

Step 3 was repeated.

Step 12—Washing

After solutions ($B_1$) and ($C_1$) have been completely added, the content of the reaction vessel was fed to the ultrafiltration unit and washed at constant volume by diafiltration while continuously adding makeup water (1 liter per mole of silver) to the emulsion for a period of 20 minutes.

The two emulsions, the control emulsion and the emulsion according to this invention, were gold and sulfur sensitized, coated each onto a poly(ethylene terephthalate) support and sensitometrically examined. The following table reports the sensitometric results.

TABLE

| | | | | Contrast | |
|---|---|---|---|---|---|
| Emulsion | Dmin | Dmax | Speed | Toe | Average |
| Control | 0.03 | 4.12 | 0.27 | 1.50 | 5.0 |
| Invention | 0.03 | 4.49 | 0.27 | 1.90 | 6.0 |

This example demonstrates the usefulness of the process for preparation of a silver halide emulsion with increased productivity, with reduced variation in volumes in the reaction vessel and with purification without interfering with nucleation and growth stages of silver halide precipitation.

EXAMPLE 2

A cubic monodispersed 0.32 μm silver chlorobromide (40 mole percent bromide) was prepared as follows using the apparatus shown in FIG. 1.

A solution (A) consisting of 4.700 l water, 0.9 g adenine and 84 g of gelatin was initially introduced into the reaction vessel 1. The components used for the silver halide grain formation were a solution (B) of 5.379 l water and 2380 g silver nitrate and a solution (C) of 5.281 l water, 688 g KCl, 733 g KBr and 0.002 g $Na_3RhCl_6.18H_2O$.

Step 1—Nucleation

Solutions (B) and (C) were introduced into the reaction vessel 1 through inlets 4 and 5 simultaneously with a vigorous stirrer 2 for a period of 9 minutes with a flow rate of 51.0 ml/min while the pAg of the content into the vessel was maintained at 8.3 and the volume of the content in the vessel was increased from 4764 ml to 5682 ml and the temperature was maintained at 56° C.

Step 2—1st Washing and Concentration

Nine minutes after beginning the precipitation, the addition of solutions (B) and (C) was stopped and the content of the reaction vessel was cycled for 3 minutes through the ultrafiltration module 7 (fitted with a polysulfone semipermeable membrane, type PTHK000C5, commercially available from Millipore Co., USA, having a NMWL of 100,000) to reduce the content volume in the reaction vessel from 5682 ml to 2082 ml. The potassium nitrate aqueous solution formed as a by-product during the precipitation of silver chlorobromide grains passed through the membrane was withdrawn as indicated by the flow path 9, while the filtered silver halide dispersion was returned to the reaction vessel as indicated by the flow path 10.

Step 3—Growth

Twelve minutes, after beginning, the addition of solutions (B) and (C) into the reaction vessel was started again for a period of 25 minutes with a flow rate of 72.0 ml/min and the volume of content in the reaction vessel was increased from 2082 to 5682 ml.

Step 4—2nd Washing and Concentration

Step 2 was repeated to reduce the content in the reaction vessel from 5682 to 3288 ml.

Step 5—Growth

Forty minutes after beginning, the addition of solutions (B) and (C) to the reaction vessel started again for a period of 7 minutes with a flow rate of 171 ml/min and the volume of content in the reaction vessel was increased from 3288 to 5682 ml.

Step 6—3rd Washing and Concentration

Step 4 was repeated.

Step 7—Growth

Fifty minutes after beginning, step 5 was repeated.

Step 8—4th Washing and Concentration

Step 4 was repeated.

Step 9—Growth

Sixty five minutes after beginning, step 5 was repeated.

Step 10—5th Washing and Concentration

After complete additions of solutions (B) and (C), the emulsion was cooled to 40° C. and washed by ultrafiltration until the conductivity was 9,000 micro S.

Gelatin (1050 g) was added to the content in the reaction vessel while stirring at 45° C. until the gelatin was dissolved. The resulting emulsion was gold and sulfur sensitized, coated onto a poly(ethylene terephthalate) support and sensitometrically examined. The properties of the emulsion were similar to those of a control emulsion prepared using ultrafiltration at the end of the precipitation and growth of silver chlorobromide grains.

I claim:

1. A process for the production of photosensitive silver halide emulsions by reacting at least one silver salt solution with at least one halide salt solution within a dispersing medium comprising a hydrophilic colloid peptizer contained in a reaction vessel to achieve silver halide grain nucleation followed by silver halide grain growth, wherein during silver halide grain growth the silver salt and halide salt solutions are concurrently added into the reaction vessel containing the dispersing medium, characterized in that there is at least one pause interposed between at least two additions of silver salt and halide salt solutions to said reaction vessel, and during said at least one pause of addition of silver salt and halide salt solutions, the volume of the silver halide emulsion is reduced by continuously delivering the silver halide emulsion to a cleaning stage, cleaning said silver halide emulsion in said cleaning stage and returning the silver halide emulsion leaving the cleaning stage to the reaction vessel.

2. The process for the production of photosensitive silver halide emulsions of claim 1, wherein the dispersing medium contains a hydrophilic colloid peptizer.

3. The process for the production of photosensitive silver halide emulsions of claim 1, wherein the concentration of soluble salts present in the silver halide emulsion delivered to the cleaning stage is from 0.1 to 3 moles per liter.

4. The process for the production of photosensitive silver halide emulsions of claim 1, wherein the cleaning stage comprises an ultrafiltration unit containing a semipermeable membrane.

5. The process for the production of photosensitive silver halide emulsions of claim 1, wherein the volume of the silver halide emulsion in the reaction vessel is maintained substantially equivalent to the starting volume of the dispersing medium in the reaction vessel.

6. The process for the production of photosensitive silver halide emulsions of claim 1, wherein the volume of the silver halide emulsion is reduced, during the pause of addition of silver salt and halide salt solutions, of an amount substantially equivalent to the amount increased by the subsequent addition of silver salt and halide salt solutions.

* * * * *